US005310086A

United States Patent [19]

Julinot

[11] Patent Number: 5,310,086

[45] Date of Patent: May 10, 1994

[54] METHOD AND APPARATUS FOR AUTOMATICALLY DISARMING SELF DEFENSE SPRAY DEVICE

[76] Inventor: Helmut Julinot, 860 Cottage Hill Ave., Mobile, Ala. 36693

[21] Appl. No.: 69,446

[22] Filed: May 27, 1993

[51] Int. Cl.[5] ..... G01F 11/00

[52] U.S. Cl. ..... 222/1; 222/153; 222/175; 222/183; 222/402.11

[58] Field of Search ..... 222/1, 153, 160, 175, 222/182, 183, 184, 402.11

[56] References Cited

U.S. PATENT DOCUMENTS

| | | | |
|---|---|---|---|
| 2,914,222 | 11/1959 | Meshberg | 222/162 |
| 3,729,119 | 4/1973 | Sette et al. | 222/153 |
| 3,754,689 | 8/1973 | Blank | 222/402.11 |
| 3,788,523 | 1/1974 | Thomas | 222/153 |
| 3,934,761 | 1/1976 | Gentreau | 222/183 |
| 4,044,922 | 8/1977 | Bordelon | 222/183 |
| 4,098,436 | 7/1978 | Kohlbeck | 222/182 |
| 4,226,339 | 10/1980 | Lardsman et al. | 222/182 |
| 4,434,914 | 3/1984 | Meshberg | 222/153 |
| 4,572,410 | 2/1986 | Brunet | 222/402.11 |
| 4,678,106 | 7/1987 | Newell et al. | 222/402.11 X |
| 4,776,941 | 10/1988 | Nitta | 222/153 |
| 4,799,877 | 1/1989 | Bisbee | 222/402.11 X |
| 4,982,522 | 1/1991 | Norton | 42/85 |

*Primary Examiner*—Andres Kashnikow
*Assistant Examiner*—Joseph A. Kaufman
*Attorney, Agent, or Firm*—Jacobson, Price, Holman & Stern

[57] ABSTRACT

An automatic disarming device for use with self defense spray devices and other devices which have been taken from their owners or their normally stored position or location which renders such devices ineffective or inoperative until the devices are returned to their proper association with the disarming device or to their proper position. More specifically, the disarming device is adapted to but not limited to use with self defense spray devices as well as other useful or noxious spray devices when such devices are taken from their owners or from their proper place of storage thereby preventing such spray devices from being used against an owner or when such devices have been removed from a stored position by an unauthorized person or a person not familiar with appropriate procedures or precautions when actuating a spray device or other device.

16 Claims, 2 Drawing Sheets

METHOD AND APPARATUS FOR AUTOMATICALLY DISARMING SELF DEFENSE SPRAY DEVICE

BACKGROUND OF THE INVENTION

1. Field of the Invention

The present invention relates to a method and apparatus for automatically disarming self defense spray devices and other devices which have been taken from their owners or their normally stored position or location which renders such devices ineffective or inoperative until the devices are returned to their proper association with the disarming device. More specifically, the disarming device is adapted to but not limited to use with self defense spray devices as well as other useful or noxious spray devices when such devices are taken from their owners or from their proper places of storage thereby preventing such spray devices from being used against an owner or when such devices have been removed from a stored position by an unauthorized person or a person not familiar with appropriate procedures or precautions when actuating a spray device or other device.

2. Description of the Prior Art

Many devices have been developed for use by law enforcement personnel or potential victims of violent crime. One of the more successful devices is the use of a pressurized container of noxious sprays or other spray dispensing devices which provides such persons with an effective means of nonlethal self defense when confronted by an assailant. Devices of this nature have been developed to discharge oleoresin capsicum, teargas, marking dyes, and a product available under the trademark "Mace", extract of the shell of the nutmeg nut or other disabling material with the spray material normally being available in a pressurized or aerosol type container or cartridge and usually released by actuating a nozzle and valve located at the top of the container. Containers with such spray material incorporated therein are frequently positioned within a shell or housing, sometimes in the form of a pistol grip type of shell, with a protective guard over the trigger to prevent accidental discharge of the material.

A well recognized problem associated with such devices is the possibility of an assailant gaining possession of the spray device by physical force with the spray device then being turned against the victim of the assault thereby incapacitating the rightful owner of the spray device. This problem has resulted in law enforcement officials and self defense experts not fully endorsing the use of such devices which has resulted in potential owners and users of such device being somewhat reticent to purchase and use self defense sprays.

The following U.S. Patents disclose devices which are somewhat relevant to the present invention.

U.S. Pat. Nos. 2,914,222
3,729,119
4,044,922
4,434,914
4,776,491
4,982,522

The above listed patents do not disclose an automatic disarming device of this invention in which the spray device or similar device is rendered ineffective and/or inoperative when such device is taken away from a rightful owner or removed from a stored position by an unauthorized person to prevent such a device being used.

SUMMARY OF THE INVENTION

An object of the present invention is to provide a method and apparatus for disarming spray devices in the form of a container or housing for spray type dispensing devices which renders the spray type dispensing device ineffective or inoperable when such devices are taken from a rightful owner by physical force or removed from a stored location by an unauthorized person with such separation of the device rendering the device ineffective and/or inoperative until it is returned to its stored location and properly associated with the rightful owner or stored location.

Another object of the invention is to provide an automatic disarming device and method in accordance with the preceding object for self defense spray devices and other devices in which the disarming device effectively disarms or renders ineffective or inoperable the spray device when it is separated from the rightful owner or its proper stored position or location with the disarming device remaining effective until the self defense spray device or other device has been returned to its rightful owner and/or stored position and properly associated with a shell or container for the self defense spray device or other device.

A further object of the invention is to provide an automatic disarming device for pressurized containers of self defense spray material or the like in the form of a housing or shell which receives the spray device with the housing or shell providing access to operate a control valve and a discharge opening aligned with a nozzle for operation of the spray device in a normal manner with the housing or shell including a removable retaining pin which retains the spray device in proper location for discharging spray material in a desired direction with the retaining pin including means tethering the pin to a rightful owner or to a stationary object whereby the pin will be separated from the housing or shell when the spray device is taken away from a rightful owner or removed from a proper stored position with removal of the pin enabling the valve actuating push button on the spray device or other device to move within the housing or shell to an inaccessible position in which the discharge nozzle is not aligned with the discharge opening thereby rendering the self defense spray or other device ineffective and/or inoperative.

A still further object of the invention is to provide an automatic disarming device for pressurized containers of self defense spray material or the like in the form of a housing or shell which receives the spray device with the housing or shell providing access to operate a control valve and a discharge opening aligned with a nozzle for operation of the spray device in a normal manner with the housing or shell including a removable retaining pin which retains the spray device in proper location for discharging spray material in a desired direction with the retaining pin including means tethering the pin to a rightful owner or to a stationary object whereby the pin will be separated from the housing or shell when the spray device is taken away from a rightful owner or removed from a proper stored position with removal of the pin enabling the valve actuating push button on the spray device or other device to move into contact with a partition wall within the housing or shell with such contact preventing the push button from being pushed downwards relative to the container, thus rendering the spray device inoperable.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
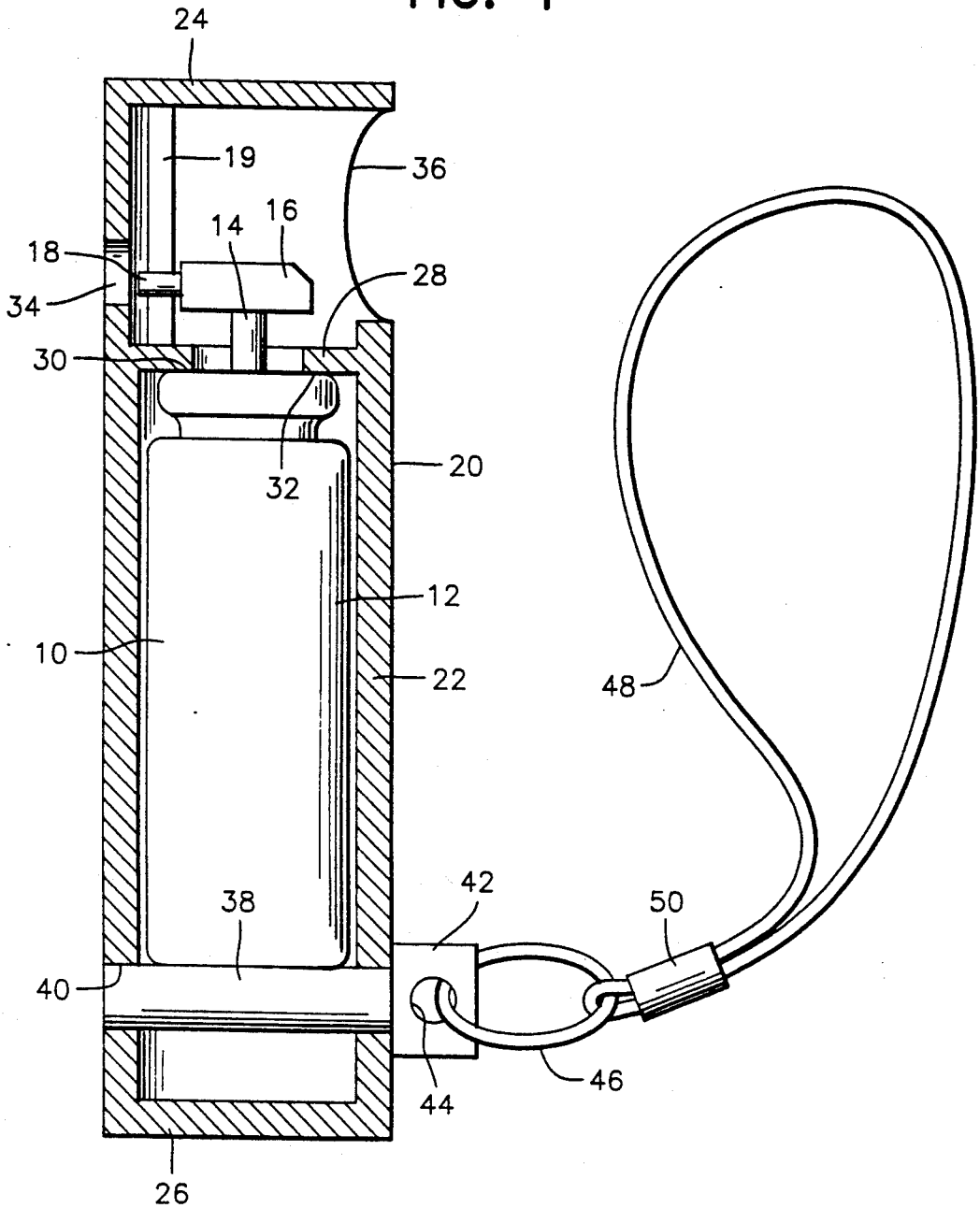
FIG. 1 is a vertical sectional view of one embodiment of the automatic disarming device of the present invention.

Referring now specifically to the drawings, FIG. 1 illustrates an embodiment of the invention in which a conventional, pressurized aerosol container for a self defense spray or other spray material is generally designated by reference numeral 10 and includes an elongated container or cartridge 12 of a length, shape and capacity in which spray materials are conventionally provided. At one end of the container 12, a valve and valve stem 14 is provided with an actuating push button 16 being mounted thereon with the push button including a passageway and discharge nozzle 18 all of which represents conventional aerosol container structures for discharging spray material from the nozzle 18 in a direction laterally away from a person gripping the housing or shell 22 and actuating the push button 16 to open the valve for passage of material through the valve stem 14, push button 16 and nozzle 18.

The automatic disarming device of the present invention is generally designated by reference numeral 20 and includes a housing or shell 22 completely enclosing the container 12. An upper end portion of the housing or shell 22 includes a top wall 24 and the lower end thereof includes a bottom wall 26 which may be of one piece construction or assembly with the housing or shell 22. Spaced below the top wall 24 of the housing or shell 22 is a transverse partition wall 28 which includes an opening 30 through which the valve stem 14 extends. However, the upper end of the container 12 cannot pass through the opening 30 and is in abutting relation to the undersurface of the partition wall 28 as indicated by reference numeral 32.

Figure 2:
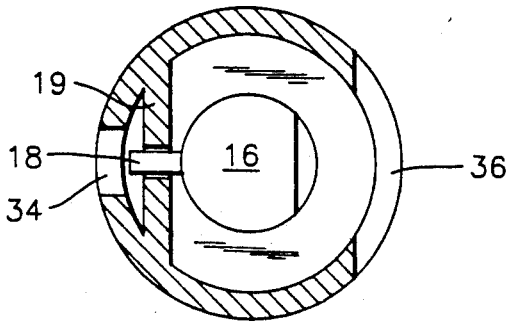
FIG. 2 is a horizontal sectional view illustrating structural details of the invention.

FIG. 2 illustrates the structure and function of two vertically extending guide flanges 19 which have inner spaced edges receiving the nozzle 18 therebetween which prevents rotation of the nozzle 18 while permitting vertical movement of the nozzle 18 in relation to the housing or shell 22.

A portion of the housing or shell 22 above the partition wall 28 is provided with a relatively small vertically extending opening 34 which is in alignment with the slot 19 and therefore with the nozzle 18 for discharge of spray material through the opening 34 when the push button 16 is actuated. In opposed relation to the opening 34, the portion of the housing or shell 22 above the transverse partition wall 28 is provided with an enlarged access opening 36 which extends from the top wall 24 downwardly to a position adjacent the transverse wall 28 thus providing a finger receiving opening to enable a person to insert their finger or thumb into the opening 36 and engage the actuating push button 16 to open the valve and enable discharge of spray material from the nozzle 18 and through the aligned opening 34.

As illustrated in FIG. 1, the housing or shell 22 is somewhat longer in length than the container 12 for the spray material. A transversely extending retainer pin 38 extends through aligned openings 40 in the housing or shell 22 at a position spaced above the bottom wall 26 and in a position that the pin 38 will retain the container 12 in its uppermost position with the upper end of the container 12 abutting the transverse wall 28 thereby enabling a person to actuate the push button 16 for discharge of material through the opening 34. However, when the retaining pin 38 is removed, the container 12 can then drop downwardly to a position that the push button 16 engages the upper surface of the transverse wall 28 and the nozzle 18 is moved out of registry with the opening 34. Since the container 12 is then suspended from the partition wall 38, the push button 16 cannot be actuated to open the valve 14 thereby disarming the self defense spray device 10.

In order to automatically remove the retaining pin and thus disarm the spray device, the pin 38 is provided with a head 42 externally of the housing or shell 22 with the head including an opening 44 receiving a ring 46 therethrough with a wrist strap or tether line 48 being connected to the ring 46. The wrist strap 48 or tether line is connected to a rightful owner by the rightful owner inserting their hand through the wrist strap and possibly moving optional slide device 50 so that the wrist strap is relatively snug around the wrist. Then, if someone physically takes the spray device from the rightful owner by grabbing the housing or shell 22 and pulling it away from the rightful owner, the pin 38 will be removed thereby disarming the spray device 10 and preventing it from being used against the rightful owner by an assailant.

The retaining pin 38 and the wrist strap 48 will remain with the rightful owner of the spray device and the assailant who has taken the housing or shell 22 and the spray device cannot actuate the spray device since removal of the pin from the housing or shell automatically disarms the spray device by rendering it ineffective and inoperative since the push button actuator 16 cannot be moved in a manner to operate the valve when the container 12 is suspended from the transverse wall 28. Even if the housing or shell 22 is inverted so that the inverted container 12 rests on the wall 28, pressure on the push button 16 will not be effective to actuate the valve since inward pressure on the push button 16 toward the container 12 will merely lift the container 1 upwardly until the push button 16 engages the wall 28. If lateral movement of the push button 16 is attempted, it cannot be moved in relation to the container 12 since the container 12 will merely slide or tilt in relation to the housing or shell since the opening 30 is larger than the valve stem 14. Also, when the spray device 10 is suspended from the wall 28, the nozzle 18 will not be aligned with or in registry with the opening 34. Thus, if any material is discharged from the nozzle 18 when in this condition, such material will not pass through the opening 34.

Figure 3:
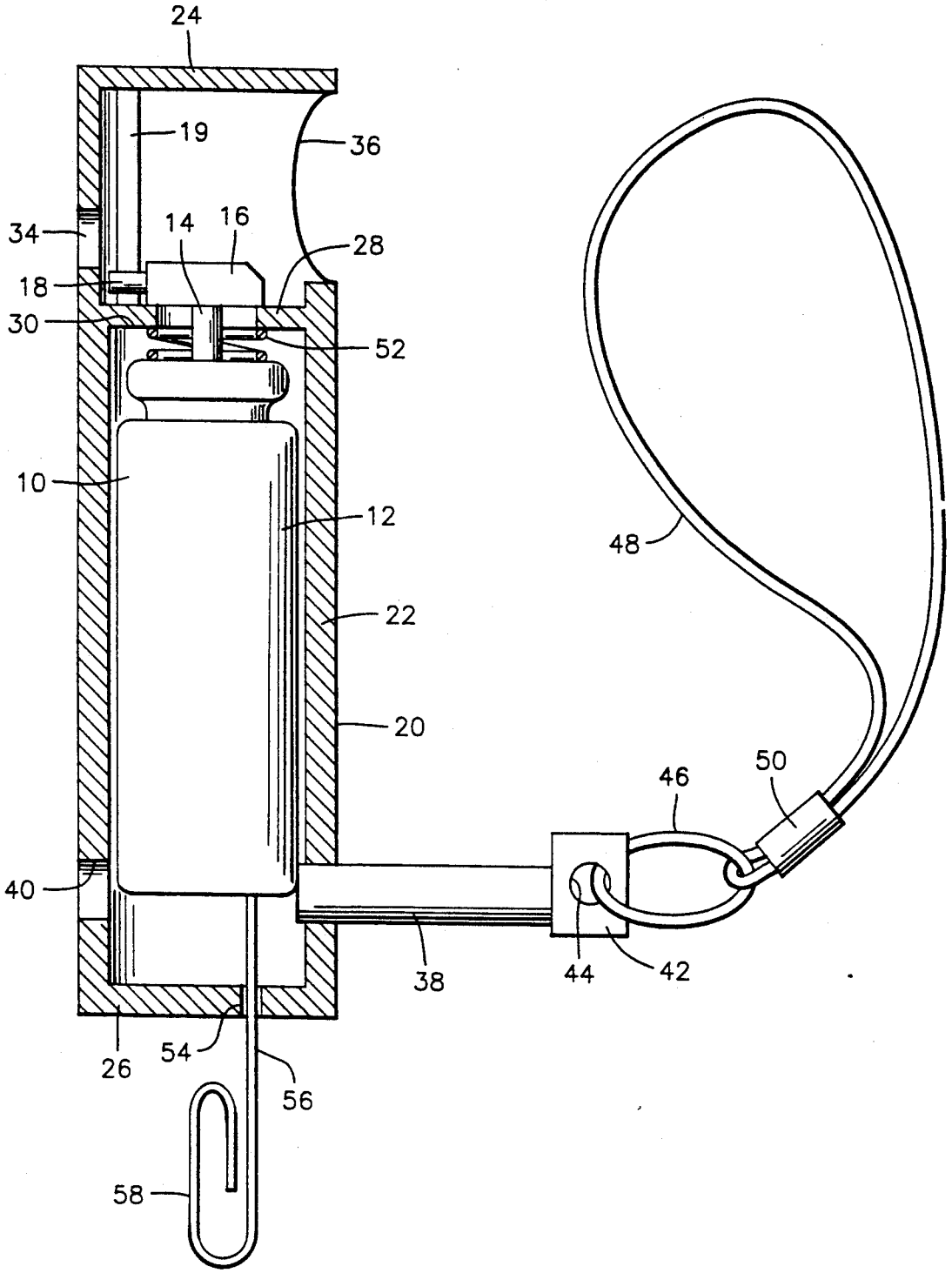
FIG. 3 is a vertical sectional view illustrating another embodiment of the invention.

FIG. 3 illustrates another embodiment of the invention which functions in a manner similar to that illustrated in FIG. 1 and the same reference numerals are applied to the same structural features. In this embodiment of the invention, a coil compression spring 52 or other elastic compression element is oriented between the top of the spray device container 12 and the transverse partition wall 28 thus biasing the container 12 downwardly when the retaining pin 38 is removed from the openings 40 as illustrated in FIG. 2. Thus, when the retaining pin 38 is removed from the housing or shell 22, the spring 52 will cause the container 12 to be moved downwardly until the push button 16 comes into contact with wall 28 and suspends the container 12. As illustrated in FIG. 2, the container 12 has already moved downwardly to a position with the push button almost engaging the wall 28 at which point the nozzle 18 is out of registry with the opening 34. This structure operates in the same manner as that in FIG. 1 except that the spring 52 provides a sufficient retention force that the container 12 will be retained in its downwardly displaced position in which it blocks openings 40 and prevents pin 38 or some other instrument from being reinserted even though the housing or shell 22 is inverted and even though attempts are made to somehow move the container 12 upwardly.

In order to be able to rearm the disarming device, the bottom wall 26 is provided with a small opening 54 which is aligned with a portion of the container 12. The small opening 54 is adapted to receive a long slender pin or rod 56 which may be the extended end of a paper clip 58 which has been partially bent into a straight line condition. Other small slender rod or wire device may be used having sufficient rigidity to overcome the tension of the spring 52 and move the container 12 upwardly to enable reinsertion of the retaining pin 38 into underlying supporting relation to the container 12 thus retaining the disarming device in operative condition. The wrist strap 48 in this embodiment of the invention operates in the same manner as in the embodiment illustrated in FIG. 1.

The aerosol container 12 and the outer holder housing or shell 22 are sized and configured that it can be conveniently held in the hand with sufficient clearance between the inside surface of the housing 22 and the container 12 to permit relative longitudinal movement unless constrained by the retaining pin. The access opening 36 enables a finger or thumb to be inserted for access to and actuation of the push button 16. The retaining pin 38 holds the container 12 in position to prevent longitudinal movement and provides a support for the container to hold it in position when the push button 16 is depressed. Thus, when the device is carried by the user the material in the container can be discharged when desired by simply inserting a thumb or finger into the opening and pushing downward on the push button. However, when the pin 38 is withdrawn such as when the device is taken from the hand of the user, the spray device becomes inoperable by virtue of the push button not being able to be pushed down relative to the container 12 thereby preventing release of spray material. A further disarming function is provided by the nozzle 18 moving below the opening 34 so that the barrier of the housing or shell 22 prevents any possible discharge of the spray material with the spray device thus being rendered disarmed and harmless for as long as the pin 38 remains removed from the openings 40.

In the device of FIG. 1, the spray device may be rearmed by merely holding it upside down and reinserting the pin 38. This rearming, however, is practically impossible to perform by the assailant who may have obtained possession of the spray device but has to catch and hold the pin which is still on the wrist of the rightful owner and reinsert it while steadily holding the device upside down. If desired, the pin 38 as well as the openings 40 may be provided with an unusual cross section which increases the difficulty of reinserting the pin and also performing a lock and key function to prevent other objects, such as a screw driver, from being utilized to rearm the device.

In the embodiment of the invention illustrated in FIG. 3, rearming is accomplished by inserting a straightened paper clip or other similar long thin rod or wire into the opening 54 to elevate the container 12 against the spring or other elastic insert 52 thus moving the container upwardly for reinsertion of the pin 38.

The retaining pin can also be in the form of other structures which perform in the same manner such as a tab, disk, wedge or the like which can support the container 12 when in a normal operating condition and release the container 12 automatically when the disarming device and spray dispenser are pulled away from the user. The wrist strap or wrist loop may be as illustrated or a tether device or other structure may be utilized for withdrawal of the retaining pin 38 such as by connecting the pin to a belt, handbag, item of clothing or the like by the use of a chain, string, belt or the like which may even be attached to furniture such as a retail counter, equipment, the interior of vehicles, dwellings or the like as long as operation of the spray device and discharge of spray material is prevented when the spray device and the housing or shell 22 are moved outside the reach of the restraining loop or tether with the spray device remaining disarmed as long as the pin 38 or other container supporting structure is ineffective to support the container 12 in its operative position. While the device has been specifically disclosed in combination with a self defense spray device, it is also effective for use in association with various other self defense devices and also in association with various aerosol containers and other types of devices which are desired to be disarmed when they are separated from the rightful owner or user or moved from a prescribed location or position.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents which may be resorted to, fall within the scope of the invention.

What is claimed as new is as follows:

1. An automatic disarming device for portable apparatuses which require manual manipulation of an actuator, said disarming device including a housing enclosing the apparatus, said housing including an access opening providing access to the actuator for the apparatus, and means supporting said apparatus within the housing for positioning the apparatus with the actuator in relation to the access opening to enable manual manipulation of the actuator through the access opening, said means supporting said apparatus in position with the actuator associated with the access opening to enable manual manipulation thereof being connected to a device externally of the housing to render the support means for the apparatus ineffective when the housing is moved away from the external device.

2. The automatic disarming device as defined in claim 1 wherein said apparatus is a spray device for discharging spray material from a container upon manual manipulation of an actuator in the form of a push button.

3. The automatic disarming device as defined in claim 2 wherein said support means includes a support member engaged with an end of the spray device, said housing receiving said spray device with the spray device including said push button actuator registered with the access opening, said support means for the spray device being separated from the housing to enable the spray device to move in relation to the housing and access opening to prevent the push button from being pushed downwardly in relation to the container due to the container being unsupported by the housing in opposed relation to the push button.

4. The automatic disarming device as defined in claim 3 wherein said housing includes an opening enabling passage of spray material, and guide means on said housing preventing angular displacement of a nozzle in relation to the opening and permitting the nozzle to move lengthwise of said housing.

5. The automatic disarming device as defined in claim 4 wherein said guide means includes a pair of opposed longitudinal flanges having spaced, aligned inner edges forming a slot receiving said nozzle.

6. The automatic disarming device as defined in claim 3 wherein said support means is a transverse pin extending through openings in said housing and engaging an end portion of the spray device to support the spray device in position with the push button accessible through the access opening.

7. The automatic disarming device as defined in claim 6 wherein resilient means is interposed between the spray device and the housing to resiliently bias the spray device to move the push button to a position to prevent manipulation thereof through the access opening when the support means is rendered ineffective.

8. The automatic disarming device as defined in claim 7 wherein said housing includes a small opening in opposed relation to the resilient means to enable a slender, substantially rigid member to be inserted therethrough to move the spray device against the bias of the resilient means to return the spray device to a position for engagement by said support means to rearm the spray device by returning it to a position with the push button accessible through the access opening.

9. The automatic disarming device as defined in claim 6 wherein said means connecting the support device to an exterior device includes a tether member connecting the support means to the external device.

10. The automatic disarming device as defined in claim 9 wherein said tether is in the form of a wrist loop for encircling the wrist of a user of the spray device and automatic disarming device to render the support means inoperative when the housing and spray device are separated from a user.

11. A method of automatically disarming a self defense spray device having a pressurized container with a push button valve and dispenser nozzle assembly at its upper end to enable discharge of spray material toward an assailant, said method consisting of the steps of enclosing the spray device within a housing having a support means for the spray device to retain the valve and nozzle assembly in registry with a discharge opening and access opening in the housing to enable discharge of spray material by inserting a finger or thumb through the access opening for actuating the valve and nozzle assembly and tethering the support means to the user of the spray device to move the support means to a position in nonsupporting relation to the spray device when the spray device and housing are separated from the user thereby enabling the valve and nozzle assembly to be unsupported and enabling movement thereof to a position that the valve and nozzle assembly on the spray device cannot be manually manipulated through the access opening.

12. The method as defined in claim 11 wherein the step of supporting the spray device includes positioning a removable support pin in engaging and supporting relation to one end of the spray device with the pin being removed when the spray device and housing are separated from the user thereby enabling the spray device to move to an inoperative position.

13. The method as defined in claim 12 wherein the step of enabling the spray device to move to an inoperative position includes the step of resilient biasing the spray device to inoperative position.

14. An automatic disarming device for apparatuses which require manual manipulation of an actuator to operate the apparatus, said disarming device including housing means receiving the apparatus, said housing means including access means providing access to the actuator for the apparatus when the apparatus is positioned with the actuator in registry with said access means, and means supporting said apparatus in relation to the housing means for positioning the apparatus with the actuator in registry with the access means to enable manual manipulation of the actuator through the access means, said means supporting said apparatus in position with the actuator in registry with the access means to enable manual manipulation thereof being connected to a device externally of the housing means to render the support means for the apparatus ineffective when the housing means is moved away from the external device to enable movement of the apparatus in relation to the housing means to a position in which the actuator is inoperable through the access means to prevent manipulation of said actuator to operate the apparatus.

15. The automatic disarming device as defined in claim 14 wherein said support means is a support member movable in relation to said apparatus to release said apparatus to move by gravity when the support member is rendered ineffective.

16. The automatic disarming device as defined in claim 15 wherein resilient means is interposed between the apparatus and the housing means to resiliently bias the apparatus to a position to prevent manipulation of the actuator through the access means when the support means is rendered ineffective by movement of the support member to release the apparatus.

* * * * *